United States Patent [19]
Kolt
[11] 4,210,277
[45] Jul. 1, 1980

[54] AUTOMATIC ROOF VENTILATOR

[75] Inventor: Stanley Kolt, Mamaroneck, N.Y.

[73] Assignee: Leonard W. Suroff, Jericho, N.Y. ; a part interest

[21] Appl. No.: 945,784

[22] Filed: Sep. 25, 1978

Related U.S. Application Data

[63] Continuation-in-part of Ser. No. 832,482, Sep. 12, 1977, Pat. No. 4,123,001.

[51] Int. Cl.² ..... F24F 7/02
[52] U.S. Cl. ..... 236/49; 49/340; 49/346; 98/2.16; 98/86
[58] Field of Search ..... 236/49; 49/339, 340, 49/346, 139, 140; 98/86, 2.14, 2.16

[56] References Cited

U.S. PATENT DOCUMENTS

| | | | |
|---|---|---|---|
| 1,314,023 | 8/1919 | Spencer et al. | 49/346 |
| 1,335,429 | 3/1920 | Danielson | 49/346 |
| 1,794,477 | 3/1931 | Sodergreen | 49/346 X |
| 2,731,902 | 1/1956 | Sebaski | 49/346 X |
| 3,667,161 | 6/1972 | Sassano | 49/346 X |
| 3,886,808 | 6/1975 | Weber | 74/569 |
| 3,921,900 | 11/1975 | Cole | 236/93 |
| 3,976,245 | 8/1976 | Cole | 236/93 A |
| 4,123,001 | 10/1978 | Kolt | 98/72 X |

*Primary Examiner*—William E. Wayner
*Assistant Examiner*—William E. Tapolcai, Jr.
*Attorney, Agent, or Firm*—Leonard W. Suroff

[57] ABSTRACT

An automatic temperature responsive assembly for ventilating through a roof a confined space to the atmosphere whereby heat buildup in the confined space may be released from the confined space or fresh air permitted to enter therein. The assembly comprises housing means adapted to be coupled to the roof of the confined space and having an opening extending therethrough with cover means operatively associated with the housing means and mounting means operatively associated with the housing means for pivotally securing the cover means thereto, so as to be movable between a generally open position and a generally closed position for enclosing the opening. A temperature responsive drive assembly is mounted to detect temperature changes in the confined space and adapted to actuate in response to temperature changes within a predetermined range, and camming means is pivotally secured relative to the housing means and including a camming surface thereon for engaging the drive assembly. Transmission means operatively extends between the cover means and the camming means for communicating movement of the drive assembly through the camming means, such that the cover means is moved to varying positions in response to temperature changes in the confined space, and guide means for providing controlled movement of the transmission means in the directions for obtaining the open position and the closed position of the cover means is provided, so as to obtain an automatic closing of the cover means in relationship to the movement in the drive assembly.

7 Claims, 6 Drawing Figures

AUTOMATIC ROOF VENTILATOR

CROSS REFERENCE TO RELATED APPLICATION

This application is a continuation-in-part of my co-pending patent application Ser. No. 832,482 filed Sept. 12, 1977, now U.S. Pat. No. 4,123,001, which entire subject matter of the co-pending application is incorporated herein by reference as if fully set forth herein.

BACKGROUND OF THE INVENTION

1. Field Of The Invention

The present invention is directed generally to an automatic ventilator, and more particularly to one ideally suited for use in motor vehicles and particularly vans. As is well known, mobile homes, vans, etc., are continuously utilized today, and the need to ventilate same in a simple and efficient manner has been required, and this is accomplished by the present invention.

2. Description Of The Prior Art

Dampers for use in air conduits or ducts in which automatic temperature responsive means are utilized have become known in the art and may be generally represented by the following patents:

| U.S. Patent No. | Date Issued |
|---|---|
| 1,737,054 | Nov. 26, 1929 |
| 3,921,900 | Nov. 25, 1975 |
| 3,976,245 | Aug. 24, 1976 |
| 4,017,026 | April 12, 1977 |

The above referenced patents set forth the prior art as it generally relates to attic venting or ventilation systems in general. In contrast to the above, it is well known to utilize a roof ventilator in motor vehicles and homes. With particular reference to motor vehicles such as campers, vans, etc., there is generally provided a roof ventilator that is manually opened and closed. This suffers from the obvious detraction in that if people are asleep at night in a camper, then there is no automatic manner by which the ventilator cover or closure is automatically closed when the temperature drops during the night. The present invention permits the user to have an automatic roof ventilator that opens and closes depending upon the temperature within the confined space, which may be an attic or the interior of the motor vehicle. Provision is also made in the present invention to maintain the ventilator in a fixed open position if so desired.

OBJECTS OF THE INVENTION

An object of the present invention is to provide an automatic roof ventilator for use with both motor vehicles as well as for home and other applications.

Another object of the present invention is to provide an automatic roof ventilator which requires no attention from the user and which automatically opens and closes without the use of any electrical energy.

Other objects and advantages of the present invention will become apparent as the disclosure proceeds.

SUMMARY OF THE INVENTION

The present invention provides for an automatic temperature responsive assembly for ventilating through a roof a confined space to the atmosphere whereby heat buildup in the confined space may be released from the confined space or fresh air permitted to enter. The assembly includes housing means adapted to be coupled to the roof of the confined space and having an opening extending therethrough, with cover means operatively associated with the housing means.

Mounting means is operatively associated with the housing means for pivotally securing the cover means thereto, so as to be movable between a generally open position and a generally closed position for enclosing the opening. A temperature responsive drive assembly is mounted to detect temperature changes in the confined space and adapted to actuate in response to temperature changes within a predetermined range. Camming means is pivotally secured relative to the housing means and includes a camming surface thereon for engaging the drive assembly.

Transmission means is operatively extending between the cover means and the camming means for communicating movement of the drive assembly through the camming means, such that the cover means is moved to varying positions in response to temperature changes in the confined space, and guide means is utilized for providing controlled movement of the transmission means in the directions for obtaining the open position and the closed position of the cover means, so as to obtain an automatic closing of the cover means in relationship to the movement in the drive assembly.

The drive assembly comprises a bottom plate with means for retaining the plate in spatially fixed position relative to the housing means and a fluid-containing bellows unit capable of expanding and contracting in response to temperature changes between predetermined limits and to generate a force upon expansion. The bellows has one end connected to the bottom plate such that the opposite end thereof is free for moving towards and away from the camming means. The transmission means includes a transmission arm mounted in fixed relation relative to the camming means and has a distal end operative for movement relative to the guide means.

The guide means includes a channel in the cover means extending substantially thereacross, and a transmission element adapted for reciprocal movement within the channel in response to expansion and contraction of the bellows resulting in movement of the free end thereof. The camming surface includes a rounded element extending outwardly therefrom for engagement with the free end of the bellows so as to transmit through the linkage of the transmission arm the necessary movement to the closure means which may be translucent to permit the entrance of light into the motor vehicle, etc.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 3:
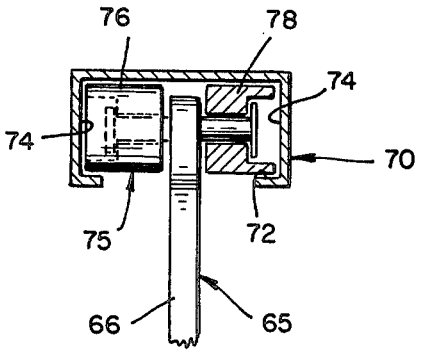
FIG. 3 is a sectional view taken along line 3—3 of FIG. 2.
Figure 4:
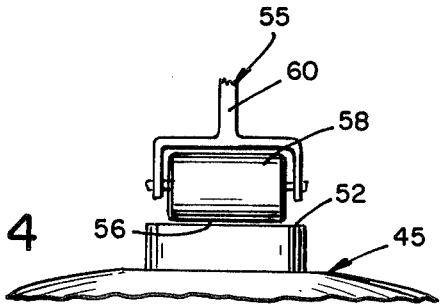
FIG. 4 is a sectional view taken along line 4—4 of FIG. 2.
Figure 5:
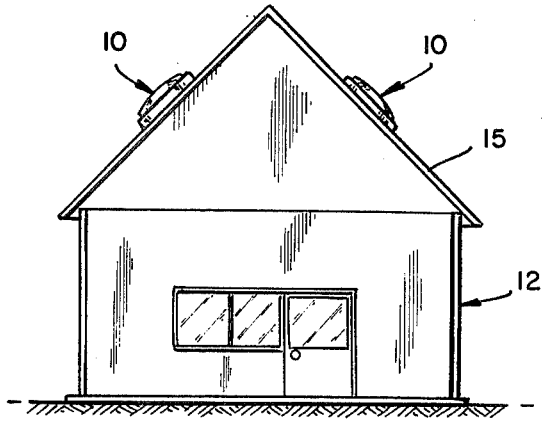
FIG. 5 is a front plan view of a dwelling illustrating the automatic roof ventilator positioned thereon.
Figure 6:
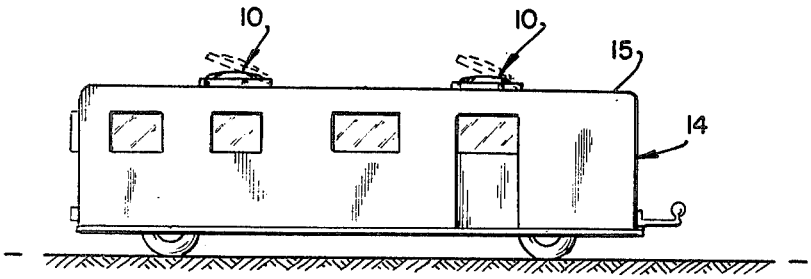
FIG. 6 is a side plan view of a vehicle having one or more automatic roof ventilators mounted thereon.

Referring to the drawings, there is illustrated in FIGS. 1 through 4 an automatic temperature responsive assembly or roof ventilator 10 that may be utilized in conjunction with a dwelling 12, as illustrated in FIG. 5, or a motor vehicle 14, as illustrated in FIG. 6. The automatic roof ventilator 10 is readily utilized and mounted on a roof 15 which may be either on a dwelling 12 or motor vehicle 14. The roof encloses a confined space 16 from which air is to exit when there is a heat buildup in the confined space 16, or fresh air is to enter.

The automatic roof ventilator 10 includes housing means 20 adapted to be coupled to the roof 15 of the confined space 16 and having an opening 22 extending therethrough. The housing means 20 may include a frame 25 that may be in various shapes and configurations. Obviously the size of the opening 22 and the frame 25 will be dependent upon the confined space 16 desired to be vented to the atmosphere. The frame 25 may include an upper end 26 and a lower end 28 that enclose the inside surface 30 of the roof 15. The upper end 26 of the frame 25 may include a rim 32 adapted to be secured as by fasteners 34 to the roof 15. In this manner the frame 25 may be permanently secured to the roof 15 with the opening 22 extending therethrough.

Figure 1:
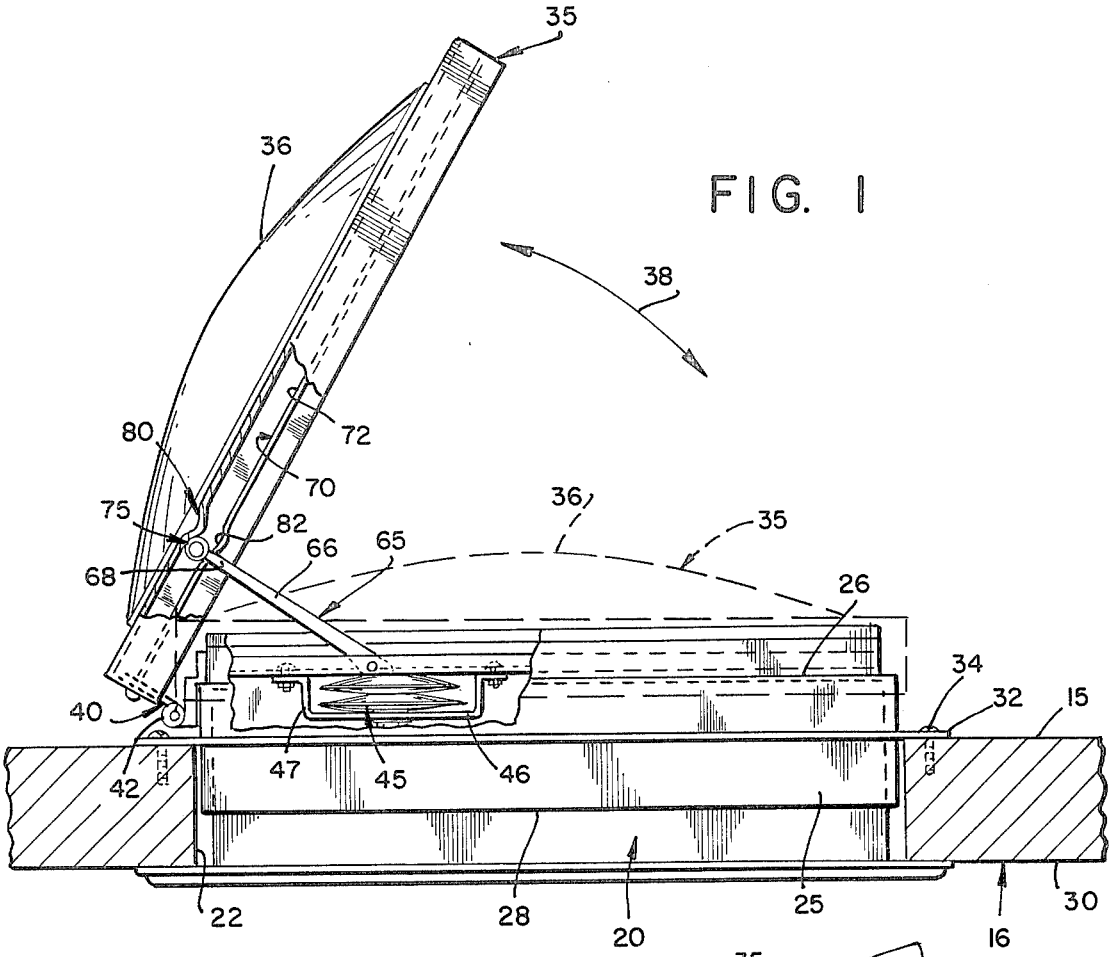
FIG. 1 is a side elevational view illustrating the relationship of the automatic roof ventilator in both its open and closed positions.

Cover means or closure 35 is operatively associated with the housing means 20. Cover means 35 may include a closure member 36 that similarly may have various shapes and conform to the size of the frame 25 to enclose the opening 22 in its closed position, as illustrated in phantom in FIG. 1. In the open position, as illustrated in FIG. 1, the cover means 35 remains open. Movement between the open position and closed position is illustrated by double headed arrow 38. The closure member 36 may be fabricated from plastic and be translucent to permit light to enter within the confined space 16.

Figure 2:
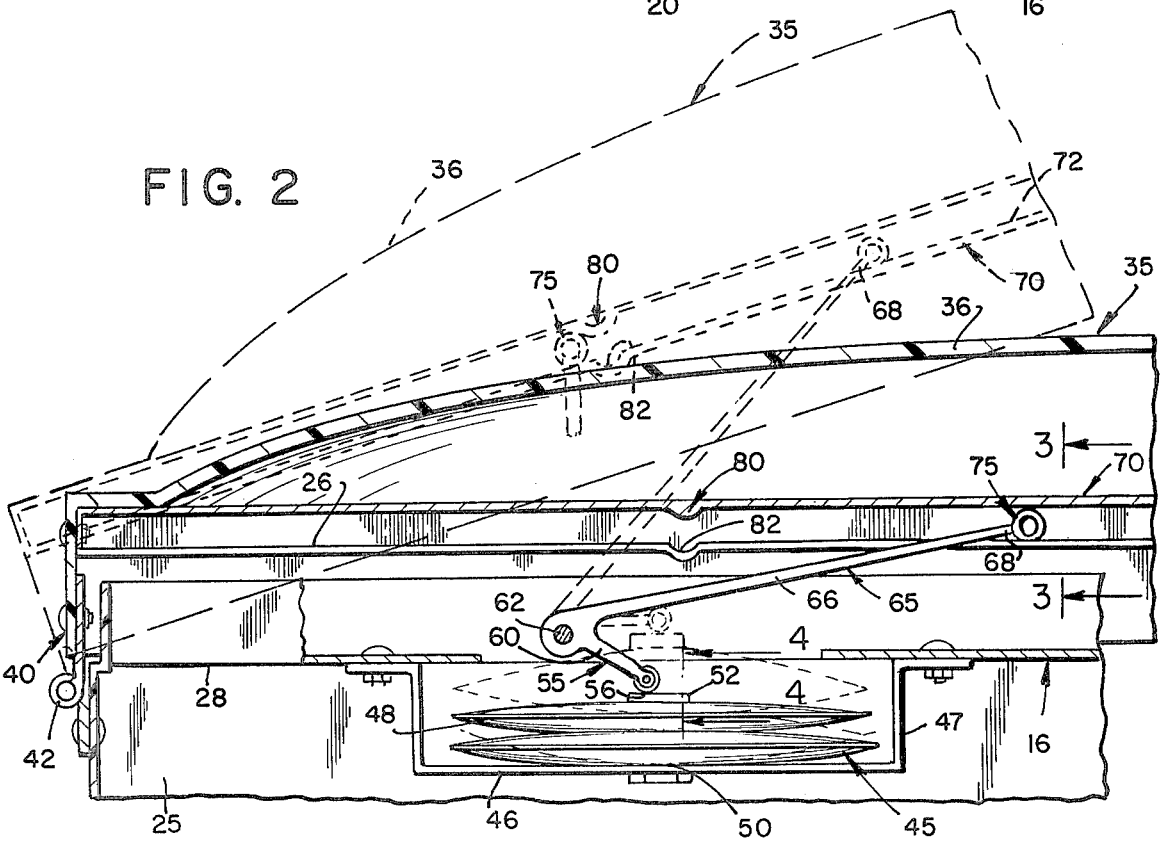
FIG. 2 is a fragmentary enlarged view of a portion of FIG. 1 illustrating the operative relationship of the automatic roof ventilator.

In order to permit the necessary movement between the open position and closed position, there is provided mounting means 40 operatively associated with the housing means 20 for pivotally securing the cover means 35 thereto so as to be movable between the respective positions. The mounting means 40 may include a hinge 42 extending along one side of the frame 25 so as to permit the pivotal movement as illustrated in FIG. 2.

To permit and obtain the automatic movement as illustrated by the double headed arrow 38, there is provided a temperature responsive drive assembly 45 mounted to detect temperature changes in the confined space 16 and adapted to actuate a response to temperature changes within a predetermined range. The drive assembly 45 includes a bottom plate 46 and a bracket or other means 47 for retaining the plate 46 in spatially fixed position relative to the housing means 20, as illustrated in FIG. 1.

A fluid-containing bellows unit 48 is provided that is capable of expanding and contracting in response to temperature changes between predetermined limits and of generating a force upon expansion. The bellows 48 has one end 50 connected to the bottom plate 46 such that the opposite end 52 is free for movement towards and away from the camming means 55.

The drive assembly 45 may be of conventional design and is filled with a heat expansible fluid, the volatility of which is matched along with the shell thickness, type of metal and volume of the unit, to provide a suitable expansion at the desired temperature range. In addition to being actuated suitable at the appropriate design temperatures, the power drive assembly of the present invention should also be capable of generating a force in the range of about 50–60 pounds per square inch in order to be operable to move the damper vanes. It will be understood that any of a number of temperature-sensitive power drive units may be utilized in assembly 45 so long as their expansion and contraction characteristics are predictable and the force generated is suitable over the desired temperature range.

The camming means 55 is pivotally secured relative to the housing means 20 and includes a camming surface 56 for engaging the drive assembly 45. The camming surface 56 may include a rounded element in the form of a roller 58, as illustrated in FIG. 4, which depends from a camming linkage or lever 60. In this manner the camming means 55 by means of the roller 58 permits minimal frictional resistance such that point contact with the free end 52 of the drive assembly 45

In this manner by pivotally mounting the camming linkage 60 by means of a pin 62 that may extend transversely through the frame 25 of the housing means 20, the linkage arm 60 is free to rotate with the vertical displacement of the free end 52.

To transmit this force, there is provided transmission means 65 operatively extending between the cover means 35 and the camming means 55 for communicating the movement of the drive assembly 45 through the camming means 55. In this manner the cover means 35 is moved to varying positions in response to temperature changes in the confined space 16.

The transmission arm 66 is mounted in fixed relation relative to the camming linkage member 60 and has a distal end 68 operative for movement relative to guide means 70 that is provided. The guide means 70 is used for providing controlled movement of the transmission means 65 in the directions for obtaining the open position and closed position of the housing means 20, as illustrated by double headed arrow 38. In this manner the automatic closing and opening of the cover means 35 in relationship to the movement of the drive assembly 45 continues to take place. The guide means 70 includes a channel 72 associated with the cover means 20 and extends substantially thereacross. The channel 72 may be of various lengths and even integrally formed with the closure member 36. Channel 72, as illustrated in FIG. 3, may include a pair of oppositely disposed tracks 74.

The guide means 70 may further include at least one roller 75. As illustrated in FIG. 3, the roller 75 includes a first wheel 76 and a second wheel 78 mounted on opposite sides of the transmission arm 66 and positioned within each of the respective tracks 74 for movement therein in response to the opening and closing of the cover means 35.

In this manner a minimal amount of friction is obtained between wheels 76 and 78 in the tracks 74 as well as at point of contact between the camming means 55 and the drive assembly 45. At the same time the guide means 70 prevents any wind from inadvertently opening the closure member 36 beyond the opening or position governed by the drive assembly 45. In this respect the guide means also acts as biasing means to prevent the cover means 35 from opening beyond a certain point as related to the temperature within the confined space 16.

There will be instances when the user is desirous of keeping the closure member 36 in a totally open position, and for that reason there has been provided locking means 80 operatively associated with the guide means 70 and transmission means 65. In this manner an open position may be obtained that is non-responsive to the movement of the drive assembly 45. The locking means 80 may include a detent 82 that extends within the channel 72 such that manual positionment of the roller 75 or wheels 76 and 78 can be accomplished and the return movement of the wheels 76 and 78 past the detent 82 must be manually accomplished. The wheels 76 and 78 may be made out of rubber, plastic, or other compressible material, or other wise dimensioned to pass the detent 82 manually.

In this manner the user of the device 10 has the benefit of having it work automatically or may selectively open same to a fixed position and thereafter return same so that automatic operation ensues. Yet at the same time any wind against the cover means 35 would not blow same open. The size and shape of the assembly 10 will vary depending upon the area to be cooled and the materials to fabricate same may vary as required.

Although an illustrative embodiment of the invention has been described in detail herein with reference to the accompanying drawings, it is to be understood that the invention is not limited to the precise embodiment, and that various changes and modifications may be effected therein without departing from the scope or spirit of the invention.

What is claimed is:

1. An automatic temperature responsive assembly for ventilating through a roof a confined space to the atmosphere whereby heat buildup in the confined space may be released from the confined space, said assembly comprising:

A. housing means adapted to be coupled to the roof of the confined space and having an opening extending therethrough, B. cover means operatively associated with said housing means, C. mounting means operatively associated with said housing means for pivotally securing said cover means thereto, so as to be movable between a generally open position and a generally closed position for enclosing said opening, D. a temperature responsive drive assembly mounted to detect temperature changes in the confined space and adapted to actuate in response to temperature changes within a predetermined range, E. camming means pivotally secured relative to said housing means and including a camming surface thereon for engaging said drive assembly, F. transmission means operatively extending between said cover means and said camming means for communicating movement of said drive assembly through said camming means, such that said cover means is moved to varying positions in response to temperature changes in the confined space, G. guide means for providing controlled movement of said transmission means in the directions for obtaining said open position and said closed position of said cover means, so as to obtain an automatic closing of said cover means in relationship to the movement in said drive assembly, H. said drive assembly comprises:

(1) a bottom plate, (2) means for retaining said plate in spatially fixed position relative to said housing means, (3) a fluid-containing bellows unit capable of expanding and contracting in response to temperature changes between predetermined limits and to generate a force upon expansion, and (4) said bellows having one end connected to said bottom plate such that the opposite end thereof is free for moving towards and away from said camming means, I. said transmission means includes a transmission arm mounted in fixed relation relative to said camming means and having a distal end operative for movement relative to said guide means, J. said guide means includes:

(5) a channel associated with said cover means extending substantially thereacross, and (6) a transmission element mounted on said distal end of said transmission arm and adapted for reciprocal movement within said channel in response to expansion and contraction of said bellows resulting in movement of said free end thereof.

2. The apparatus as defined in claim 1, wherein said camming surface includes a rounded element extending outwardly therefrom for engagement with said free end of said bellows.

3. The apparatus as defined in claim 2, wherein said rounded element is a roller to essentially make point contact with said free end of said bellows.

4. The apparatus as defined in claim 1, wherein:

a. said guide means is mounted in fixed relationship to said cover means, and b. said transmission element includes at least one roller mounted on said transmission arm.

5. The apparatus as defined in claim 4, wherein:

a. said channel includes a pair of oppositely disposed tracks, and b. said roller includes a first wheel and a second wheel mounted on opposite sides of said transmission arm and positioned within each of said respective tracks for movement therein in response to the opening and closing of said cover means.

6. The apparatus as defined in claim 4, including locking means operatively associated with said guide means and transmission means so as to permit positionment of said closure means in an open position such that it is non-responsive to the movement of said drive assembly.

7. The apparatus as defined in claim 6, wherein said locking means includes a detent in said channel and manual positionment of said roller past said detent maintains said closure means in said open position thereof.

* * * * *